US005894009A

United States Patent [19]

Luven

[11] Patent Number: 5,894,009

[45] Date of Patent: Apr. 13, 1999

[54] VACUUM TIGHT REACTION VESSEL FOR STEEL PROCESSING WITH A PACKING GLAND

[75] Inventor: Arno Luven, Krefeld, Germany

[73] Assignee: Technometal Gesellschaft für Metalltechnologie mbH, Duisburg, Germany

[21] Appl. No.: 08/952,590

[22] PCT Filed: May 10, 1996

[86] PCT No.: PCT/DE96/00853

§ 371 Date: Nov. 19, 1997

§ 102(e) Date: Nov. 19, 1997

[87] PCT Pub. No.: WO96/36741

PCT Pub. Date: Nov. 21, 1996

[30] Foreign Application Priority Data

May 19, 1995 [DE] Germany ..... 195 18 361

[51] Int. Cl.[6] ..... C21C 7/10; C22B 9/05

[52] U.S. Cl. ..... 266/211; 266/226

[58] Field of Search ..... 266/208, 211, 266/225, 226, 270

[56] References Cited

U.S. PATENT DOCUMENTS

| | | | |
|---|---|---|---|
| 3,669,437 | 6/1972 | Wernicke | 266/226 |
| 4,465,265 | 8/1984 | Kryczum et al. | 266/226 |

FOREIGN PATENT DOCUMENTS

| | | |
|---|---|---|
| 0584814 | 3/1994 | European Pat. Off. . |
| 2461859 | 7/1975 | Germany . |
| 2918213 | 11/1979 | Germany . |
| 3225772 | 1/1984 | Germany . |

*Primary Examiner*—Scott Kastler
*Attorney, Agent, or Firm*—Robert W. Becker & Associates

[57] ABSTRACT

A vacuum tight reaction vessel for steel processing has a vessel bottom and a cover that can be placed vacuum-tightly on the vessel bottom. The cover has a packing gland as a vacuum-tight passage. The packing gland includes a packing gland housing fixedly connected to the cover, a packing gland seal, and a packing gland passage for guiding a blast pipe that is vertically movable relative to the cover. A lateral compensator connects the packing gland passage to the packing gland housing and allows lateral movements of the packing gland passage relative to the packing gland housing.

9 Claims, 2 Drawing Sheets

VACUUM TIGHT REACTION VESSEL FOR STEEL PROCESSING WITH A PACKING GLAND

BACKGROUND OF THE INVENTION

The invention relates to a vacuum tight reaction vessel for steel processing, comprising a vessel bottom and a cover that can be placed thereon in a vacuum tight manner. The cover comprises a vacuum tight passage, that is embodied in the manner of a packing gland with a packing gland housing fixedly connected to the cover, a packing gland seal, and a packing gland passage, for guiding a blast pipe that is vertically movable relative to the cover.

Reaction vessels having the aforementioned features are known in practice for steel processing. For moving the blast pipe, guided through the packing gland into the interior of the vessel, a support with a carriage displaceably arranged thereat and a coordinated drive unit is, in general, provided at the cover of the vessel whereby the blast pipe is supported. A coordinated drive unit is provided This arrangement has the disadvantage, respectively, results in the problem that due to imprecise manufacturing dimensions as well as due to thermal loading of the components during operation, tolerances result which impede a straight and thus friction-reduced and easy movement of the blast pipe through the packing gland. The result is that, due to the high movement resistance, the blast pipe upon passage through the packing gland, when the driving power of the carriage is too high, is bent or that the carriage drive cannot provide sufficient power to overcome the moving resistance.

It is therefore an object of the invention to improve a vacuum tight reaction vessel with the aforementioned features such that in all operation positions a secure and easy movement of the blast pipe through the packing gland is achieved.

SUMMARY OF THE INVENTION

The solution to this object results, including advantageous embodiments and further improvements of the invention, from the contents of the claims which follow this description.

The basic principle of the invention is that the packing gland passage is arranged with lateral play relative to the packing gland housing and is connected to the packing gland housing by a lateral compensator which allows lateral movements of the packing gland passage with the blast pipe guided therein. This has the advantage that a lateral movement of the packing gland passage, guiding the blast pipe, relative to the stationary packing gland housing, connected to the cover, is possible due to the arrangement of the lateral compensator so that in this manner manufacturing tolerances or thermally produced tolerances can be compensated.

According to one embodiment of the invention it is suggested that one of the end flanges of the lateral compensator is connected to the packing gland passage and the other oppositely arranged end flange of the lateral compensator is connected to the packing gland housing. The lateral compensator, surrounding annularly the packing gland passage, can be arranged within the intermediate space between the packing gland passage and the packing gland housing, especially in the area of one end flange and/or in the area of the other end flange, with lateral play relative to the packing gland housing.

In one embodiment of the invention, the packing gland passage is comprised of a guide member, surrounding the blast pipe and receiving the packing gland seal, and a passage member, resting thereon and fixedly connected to the guide member. The guide member comprises a radially projecting flange for abutment at the corresponding end flange of the lateral compensator.

In order to prevent leakage during lateral movements of the packing gland passage guiding the blast pipe relative to the packing gland housing, according to one embodiment of the invention it is suggested that the interior space of the lateral compensator itself is under vacuum, too. For this purpose, the interior space of the lateral compensator is connected via at least one corresponding bore, penetrating the packing gland housing and/or corresponding connecting parts such as the lid socket or base plate, with the interior of the vessel.

When flushing the vessel before removing the cover from the vessel bottom, there is the risk that dirt particles can be entrained into the interior of the lateral compensator. According to one embodiment of the invention, it is therefore suggested that the interior space of the lateral compensator is connected to the atmosphere by a bore that can be closed or opened by a valve. This is advantageous because, before or parallel to flushing of the vessel, the interior space of the lateral compensator can also be flushed so that no foreign particles can enter the interior space. According to one embodiment of the invention, the bore provided for this purpose is arranged at the flange of the guide member of the packing gland passage.

The invention can also be used in connection with an embodiment of the packing gland in which the packing gland seal is an inflatable seal and the packing gland itself is sealable relative to the interior of the vessel by a noble gas buffer to be supplied via a flushing device. In this embodiment it is also expedient to connect the interior space of the lateral compensator to the vacuum within the vessel interior and to provide for this purpose a communication between the vessel interior and the interior space of the lateral compensator. Also, an additional bore for flushing in the opposite direction should be provided.

BRIEF DESCRIPTION OF THE DRAWINGS

In the drawings, embodiments of the invention are represented which will be explained in the following.

It is shown in.

DESCRIPTION OF PREFERRED EMBODIMENTS

Figure 1:
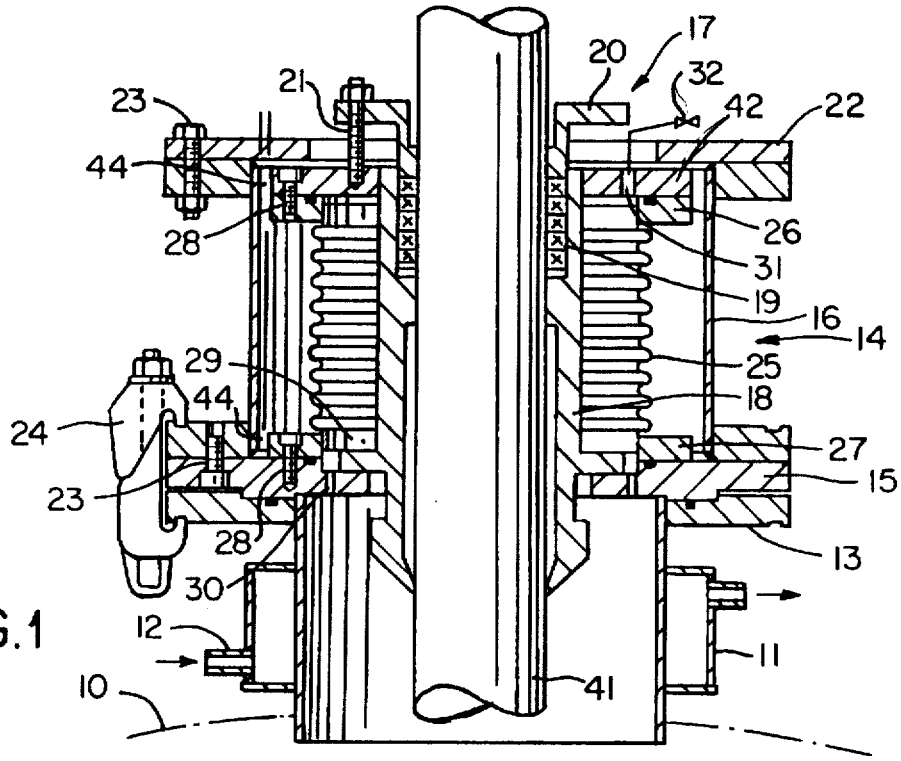
FIG. 1 the cover of a reaction vessel with packing gland in section.

The arrangement shown in FIG. 1 is comprised of a cover 10 and a cover socket 11 seated thereon which can be cooled by cooling water supplied via connectors 12. At the upper edge of the cover socket 11 a circumferential flange 13 is provided onto which the packing gland 14 is placed and to which it is connected by clamping screws 24. For this purpose a base plate 15 as a support for the packing gland housing 16 is positioned on the flange 13 of the cover socket 11. A packing gland passage 17 is arranged with lateral play 44 within the annular packing gland housing 16. The passage 17 is comprised of a guide member 18 that receives and guides the blast pipe 41 and a passage member 20 positioned thereon. The guide member 18 and the passage member 20 surround the packing gland seal 19 and secure it. The guide member 18 and the passage member 20 are connected with screw connectors 21 to one another. The packing gland passage 17 is secured by a securing plate 22 connected to the upper edge of the packing gland housing 16, whereby this securing plate 22 rests on the guide member 18 and thus secures the entire packing gland passage 17. On one side, screw connectors 23 secure the securing plate 22 to the packing gland housing 16, and, on the other side, secure the packing gland housing 16 to the base plate 15. The clamping screws 24 mentioned above secure the lower flange of the packing gland housing 16 at the flange 13 of the cover socket 11.

In the intermediate space between the packing gland passage 17 and the packing gland housing 16 a lateral compensator 25 is arranged which is embodied as a metal tube and annularly surrounds the packing gland passage 17. The lateral compensator 25 has an upper flange 26 and a lower flange 27. The upper flange 26 is connected with screw connectors 28 to the flange 42 of the guide member 18, and the lower flange 27 of the lateral compensator 25 is connected with screw connectors 28 to the base plate 15.

Due to the aforedescribed arrangement, the packing gland passage 17 is laterally movable within the range of play 44, provided within the area of the upper flange 26, relative to the packing gland housing 16 surrounding the guide member 18, because the lateral compensator 25 embodied as a metal tube allows a lateral displacement of the upper flange 26 relative to the lower flange 27.

In order to ensure flexibility of the compensator 25 during lateral movements, the interior space 29 of the lateral compensator 25 is to be subjected to the vacuum present within the vessel interior by providing a bore 30 within the base plate 15 that communicates with the interior 29 of the lateral compensator 25. Via this at least one bore (it is also possible to provide more than one bore) a respective vacuum is provided in the interior 29 of the lateral compensator 25. In order to avoid entrainment of dirt particles into the interior space of the compensator 25, a further bore 31 is arranged in the area of the upper flange 26 of the lateral compensator 25. It extends through the flange 42 of the guide member 18 of the packing gland passage 17. This bore 31, respectively, a line that is connected thereto, can be opened or closed by a valve 32. In this manner, at a point in time before or simultaneously to the flushing of the vessel, the interior space 29 of the lateral compensator 25 can also be connected to the atmosphere.

Figure 2:
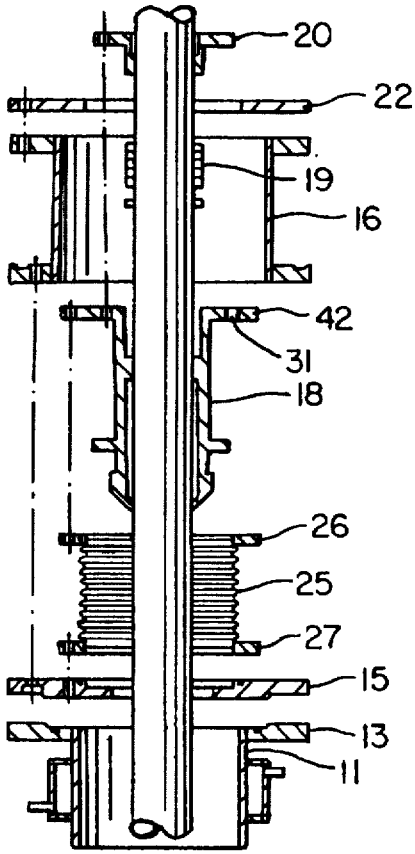
FIG. 2 the design of the inventive packing gland with individual parts shown in an exploded view.

The construction of the packing gland with corresponding connections can be especially well seen within the exploded view of FIG. 2 showing the individual parts of the packing gland.

Figure 3:
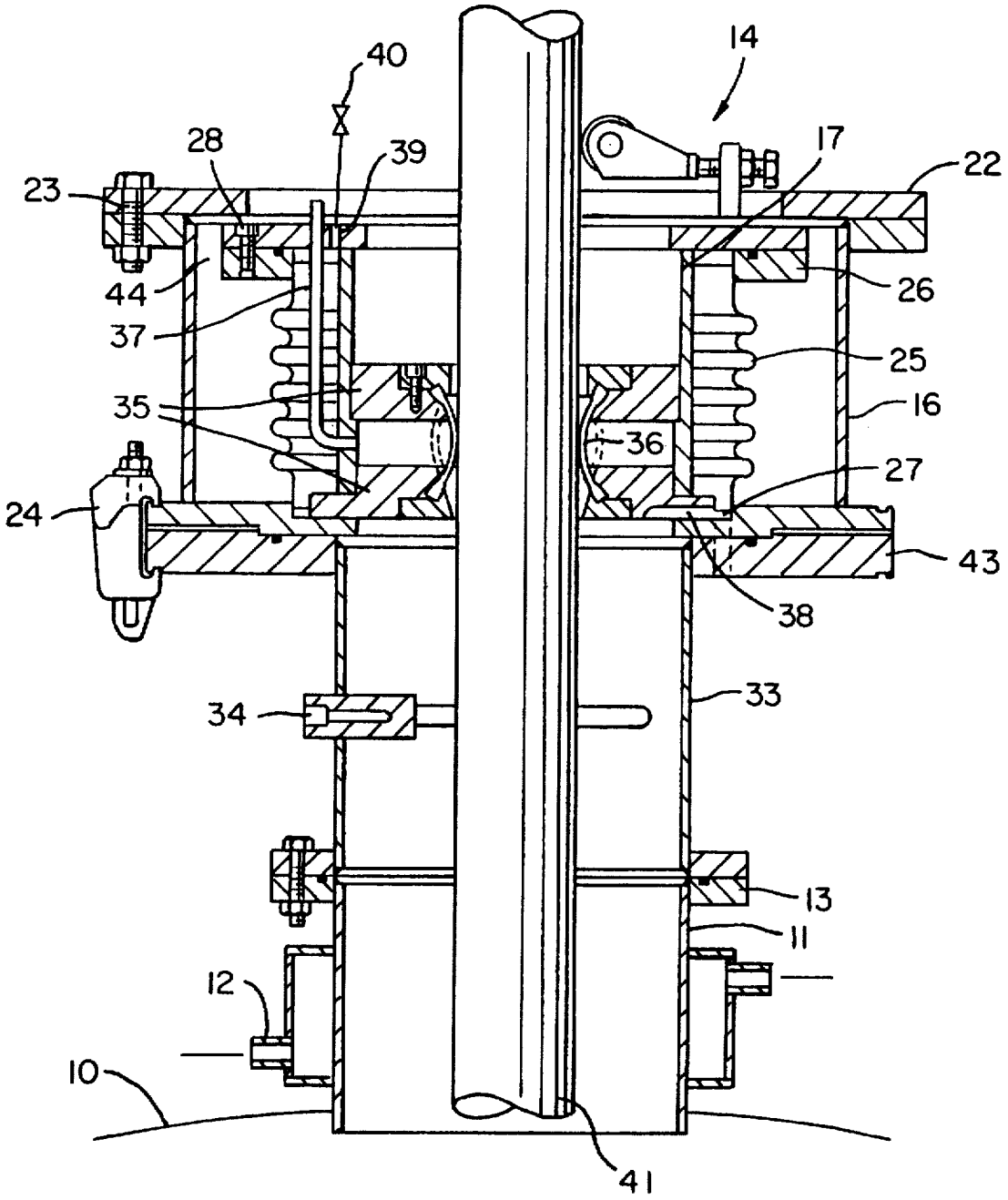
FIG. 3 the device of FIG. 1 in another embodiment.

In the embodiment represented in FIG. 3, an alternative construction is shown in which the packing gland seal is of a different design. In this embodiment, an intermediate piece 33 is placed onto the flange 13 of the cover socket 11 and is provided with a flushing device in the form of connectors 34 for introducing a noble gas. The packing gland 14 is now positioned on the corresponding upper flange 43 of the intermediate member 33.

This packing gland 14 comprises a somewhat simplified design relative to the embodiment of FIG. 1 since the packing gland housing 16 is directly positioned on the upper flange 43 of the intermediate member 33 and secured thereat by respective clamping screws 24.

The packing gland passage 17 arranged inside the packing gland housing 16 comprises annular projections 35 positioned axially spaced relative to one another. An inflatable seal 36 is positioned therebetween and is to be brought into contact with the blast pipe 41. A control line 37 extends into the intermediate space and is connectable either to compressed air for inflating the inflatable seal or to a vacuum for releasing the inflatable seal 36.

In this embodiment a lateral compensator 25 is also arranged in the intermediate space between the packing gland passage 17 and the packing gland housing 16. The upper flange 26 of the lateral compensator is connected by respective screw connectors 28 to the packing gland passage 17, and the lower flange 27 positive-lockingly but loosely engages, with lateral play, the base plate of the packing gland housing 16 so that a respective flexibility between the lateral compensator 25 and the packing gland housing 16 is realized.

In this embodiment, the interior space 29 of the lateral compensator 25 is also in communication with the vessel interior via passage 38 between the packing gland passage 17 and the packing gland housing 16. For counter flushing a bore 39 with valve 40 is provided.

The present invention is, or course, in no way restricted to the specific disclosure of the specification and drawings, but also encompassess any modifications within the scope of the appended claims.

What I claim is:

1. A vacuum tight reaction vessel for steel processing, said vacuum tight reaction vessel comprising:

a vessel bottom and a cover that can be placed vacuum-tightly on said vessel bottom;

said cover comprising a packing gland as a vacuum-tight passage;

said packing gland comprising a packing gland housing fixedly connected to said cover, a packing gland seal, and a packing gland passage for guiding a blast pipe that is vertically movable relative to said cover;

a lateral compensator connecting said packing gland passage to said packing gland housing and allowing lateral movements of said packing gland passage relative to said packing gland housing;

said lateral compensator having oppositely arranged end flanges and wherein a first one of said end flanges is connected to said packing gland passage and a second one of said end flanges is connected to said packing gland housing.

2. A reaction vessel according to claim 1, wherein said lateral compensator annularly surrounds said packing gland passage and is positioned in an intermediate space between said packing gland passage and said packing gland housing, said lateral compensator arranged with lateral play relative to the packing gland housing in the area of said first end flange or in the area of said second end flange.

3. A reaction vessel according to claim 1, wherein said lateral compensator annularly surrounds said packing gland passage and is positioned in an intermediate space between said packing gland passage and said packing gland housing, said lateral compensator arranged with lateral play relative to the packing gland housing in the area of said first end flange and in the area of said second end flange.

4. A reaction vessel according to claim 1, wherein said packing gland passage is comprised of a guide member, receiving said packing gland seal and surrounding the blast pipe, and a passage member positioned on said guide member and fixedly connected to said guide member, wherein said guide member comprises a radially projecting flange for abutment at one of said end flanges of said lateral compensator.

5. A vacuum tight reaction vessel for steel processing, said vacuum tight reaction vessel comprising:

a vessel bottom and a cover that can be placed vacuum-tightly on said vessel bottom;

said cover comprising a packing gland as a vacuum-tight passage;

said packing gland comprising a packing gland housing fixedly connected to said cover, a packing gland seal, and a packing gland passage for guiding a blast pipe that is vertically movable relative to said cover;

a lateral compensator connecting said packing gland passage to said packing gland housing and allowing lateral movements of said packing gland passage relative to said packing gland housing;

wherein said lateral compensator has an interior space connected to an interior of said reaction vessel by at least one bore such that said interior space is under vacuum when said reaction vessel is under vacuum.

6. A reaction vessel according to claim 5, further comprising a bore, having a valve for closing and opening said bore, connecting said interior space of said lateral compensator to the atsmophere.

7. A reaction vessel according to claim 6, wherein said bore is arranged within said radially projecting flange of said guide member.

8. A reaction vessel according claim 1, further comprising a flushing device for introducing a noble gas buffer and sealing said packing gland relative to the interior of said reaction vessel by said noble gas buffer, wherein said packing gland seal is an inflatable seal.

9. A reaction vessel according claim 5, further comprising a flushing device for introducing a noble gas buffer and sealing said packing gland relative to the interior of said reaction vessel by said noble gas buffer, wherein said packing gland seal is an inflatable seal.

* * * * *